US006165049A

United States Patent [19]

Yamaguchi

[11] Patent Number: 6,165,049

[45] Date of Patent: Dec. 26, 2000

[54] GOLF BALL DEBURRING METHOD

[75] Inventor: Takehiko Yamaguchi, Chichibu, Japan

[73] Assignee: Bridgestone Sports Co., Ltd., Tokyo, Japan

[21] Appl. No.: 09/340,189

[22] Filed: Jun. 28, 1999

[30] Foreign Application Priority Data

Jun. 26, 1998 [JP] Japan ..... 10-196702

[51] Int. Cl.[7] ..... B24B 49/00

[52] U.S. Cl. ..... 451/6; 451/49; 451/50

[58] Field of Search ..... 451/50, 49, 449, 451/28, 262, 268, 6, 9, 32, 59, 244, 246

[56] References Cited

U.S. PATENT DOCUMENTS

| | | | |
|---|---|---|---|
| 3,640,028 | 2/1972 | Richard | 451/50 |
| 4,894,958 | 1/1990 | Takasaki | 451/50 |
| 5,611,723 | 3/1997 | Mitoma et al. | 451/6 |
| 5,658,188 | 8/1997 | Yamada et al. | 451/50 |

FOREIGN PATENT DOCUMENTS

| | | |
|---|---|---|
| 63-099884 | 5/1988 | Japan . |
| 63-109880 | 5/1988 | Japan . |

*Primary Examiner*—Derris H. Banks

*Attorney, Agent, or Firm*—Sughrue, Mion, Zinn, Macpeak & Seas, PLLC

[57] ABSTRACT

A molded golf ball having burrs in a region of its surface is ground using a grinding head having an abrasive surface of a sufficient width or diameter to cover the burr-bearing region of the golf ball surface and a drive mechanism for driving the grinding head. The drive mechanism is actuated to drive the grinding head to bring and force the abrasive surface against the burr-bearing region of the golf ball surface for grinding away the burrs. The point of time when the drive mechanism experiences a load change beyond the predetermined value is detected by a control unit to deliver a signal representing the substantial completion of grinding, in response to which the grinding step is terminated.

15 Claims, 4 Drawing Sheets

GOLF BALL DEBURRING METHOD

The present invention relates to a golf ball deburring method capable of precise grinding of a golf ball by efficiently grinding only a burr-bearing region on the surface thereof while avoiding grinding of unnecessary regions.

BACKGROUND OF THE INVENTION

For the molding of golf balls, especially the molding (final molding) of covers, compression molding and injection molding processes are well known. The compression molding process uses a two-split mold having a plurality of projections corresponding to dimples on the cavity-defining inner wall. After the cover stock is previously shaped into half cups, a core is enclosed in a pair of the cover stock half cups, which is placed in the mold where molding is carried out under heat and pressure. The injection molding process uses a two-split mold having a plurality of gates (typically about 8 equally spaced gates) at the parting line of the mold. After a core is held at the center of the mold cavity to leave a space between the core and the cavity-defining inner wall, a molten thermoplastic resin is injected under pressure into the space through the gates. The mold used in the injection molding process has a venting mechanism including vertically extending cylindrical pins located at the opposite poles of the cavity and holes for receiving the pins to leave gaps, so that air in the space may be discharged through the gaps upon resin injection. The injection mold further has a core supporting mechanism including cylindrical support pins disposed in the mold halves for motion toward and away from the core for supporting the core from vertically opposed directions for placing the core at the center of the cavity, the support pins being received in holes. The support pins are spaced aside from the venting pins.

In the case of compression molding, a ball as molded has an annular burr like Saturn's rings at the parting line or equator of the mold. In the case of injection molding, the resin cures within the gates at the equator to leave gate marks, the resin is squeezed out at the parting line to leave burrs, and the resin penetrates into the gaps between the pins and the holes of the venting mechanism and the support mechanism and cures therein to leave burrs. All of these burrs including burrs at the equator, gate marks, and burrs at the opposite poles and nearby positions must be removed. Trimming is fairly effective for removing burrs, but still leaves burrs 2-1 on a golf ball 1 near one pole as shown in FIG. 3. Since it is difficult to completely remove such burrs by trimming, it is necessary to grind away the burrs 2-1.

Referring to FIGS. 4 and 5, one prior art well-known grinding method which is applied to burrs at the parting line is illustrated. This method is used to remove gate marks resulting from injection molding although it is applicable to the removal of burrs resulting from compression molding. As shown in FIG. 4, a golf ball 1 having gate marks 2-2 along its equator is secured by a pair of holders 3, 3 abutting the opposed poles thereof. A grinding wheel 4 having a working surface 5 with a sufficient width a to cover a region of gate marks 2-2 is disposed such that the working surface 5 will come in contact with the ball 1 at its equator. The abrasive surface 5 is advanced toward the ball 1 while the grinding wheel 4 is rotated in the direction of arrow A' and the ball is rotated in the direction of arrow B' as shown in FIG. 5. The burrs are abraded away under the visual observation of the operator.

Referring to FIGS. 6 to 8, a second prior art grinding method which is applied to burrs near the opposed poles and the parting line is described (see JP-A 63-109880). As shown in the plan view of FIG. 6, a grinding apparatus includes three shafts 6 disposed on the same plane at 120° intervals so that the center axes of all three shafts meet at the center O of a golf ball 1 seated in a golf ball holder (not shown). Each shaft 6 is movable in its axial direction and rotatable about its own axis. The apparatus further includes a mechanism for moving the shafts 6 in their respective axial directions and rotating the shafts about their respective axes. As shown in FIGS. 7 and 8 which are an enlarged cross-sectional view and an end view of the shaft, respectively, each shaft 6 has a working surface 7 which is formed as a concave spherical surface of the same curvature as the surface of the golf ball 1. The working surface 7 is provided with a circular recess 8 for collecting chips (ground pieces of burrs) and radial channels 9 for discharging chips. With this apparatus, grinding is carried out by pushing the shafts against the ball while rotating each shaft in the same direction. Grinding is performed while mutually varying the pressure against the ball and/or rotational speed of each of the three shafts. This causes the ball to turn during grinding, enabling the entire surface of the ball to be uniformly ground.

However, the first method shown in FIGS. 4 and 5 is difficult to precisely control the depth (or stock removal) of grinding since the depth of grinding is determined under the visual observation of the operator. One reason is that the working surface itself is worn and loaded (or dulled). As the working surface becomes worn and loaded, it becomes less abrasive. Then the stock removal of grinding must be adjusted by extending the grinding time or changing the feed rate. The working tool must be replaced when a certain limit is reached, or while the life of the working tool is monitored as a function of the actual use time. It is thus difficult to achieve a consistent stock removal of grinding. Also, since the replacement of the working tool relying on the monitoring of its life generally takes safety allowance, the working tool must be replaced before the expiration of its life.

In the method shown in FIGS. 4 and 5, the operator manages only such factors as the working time and feed rate, and it depends solely on visual observation to determine how much the ball is ground.

As one solution, JP-A 63-99884 proposes a method for grinding a golf ball over its entire surface. The stock removal of grinding from the ball can be confirmed by this method, although it still depends on a trial-and-error process to determine optimum conditions.

The second method shown in FIGS. 6 to 8 not only requires a skilled operator like the first method, but also grinds those regions of the ball's surface that are unnecessary to remove.

In general, a golf ball has on its surface a plurality of dimples which are formed to a depth at a tolerance of within ±5 microns. An excessive depth of grinding can destroy the precise surface topography which has been carefully imparted to the dimple-bearing surface of the ball. The resulting decline in the precision of the ball's surface topography, and especially in the precision of the dimple depths, causes the golf ball, when hit, to rise too sharply or to deviate right or left, which is evidence of a deterioration in the flight performance. This problem is inevitable with the second method. Even the first method cannot avoid a certain degree of uneven grinding because of the grinding operation under visual observation, even if a skilled operator is in charge.

SUMMARY OF THE INVENTION

Therefore, an object of the invention is to provide a method for grinding a golf ball so that substantially only a burr-bearing region may be removed at precision.

In the manufacture of a golf ball, the ball is molded in the state that the ball has burrs in a region of its surface. The invention provides a method for grinding the golf ball as molded using a grinding means having an abrasive surface of a sufficient width or diameter to cover the burr-bearing region of the golf ball surface and a drive means for driving the grinding means. The method involves the step of actuating the drive means to drive the grinding means to bring and force the abrasive surface of the grinding means against the burr-bearing region of the golf ball surface for grinding away the burrs. The point of time when the drive means experiences a load change beyond a predetermined load is recognized or detected as a signal representing the substantial completion of grinding, and the grinding step is accordingly terminated.

In one preferred embodiment, the grinding means is a grinding wheel, and the drive means includes a first drive (or motor) for rotating the grinding wheel about its axis and a second drive for moving the grinding wheel toward and away from the golf ball.

The grinding method of the invention is effective for removing burrs that are formed during molding of the golf ball, especially the cover. By ensuring to detect the completion of grinding, the grinding time for deburring is optimized, thereby effectively removing only the burrs and minimizing the grinding of extra regions. The burrs on the golf ball can be abraded away without detracting from the ball quality.

DESCRIPTION OF THE PREFERRED EMBODIMENTS

Figure 1:
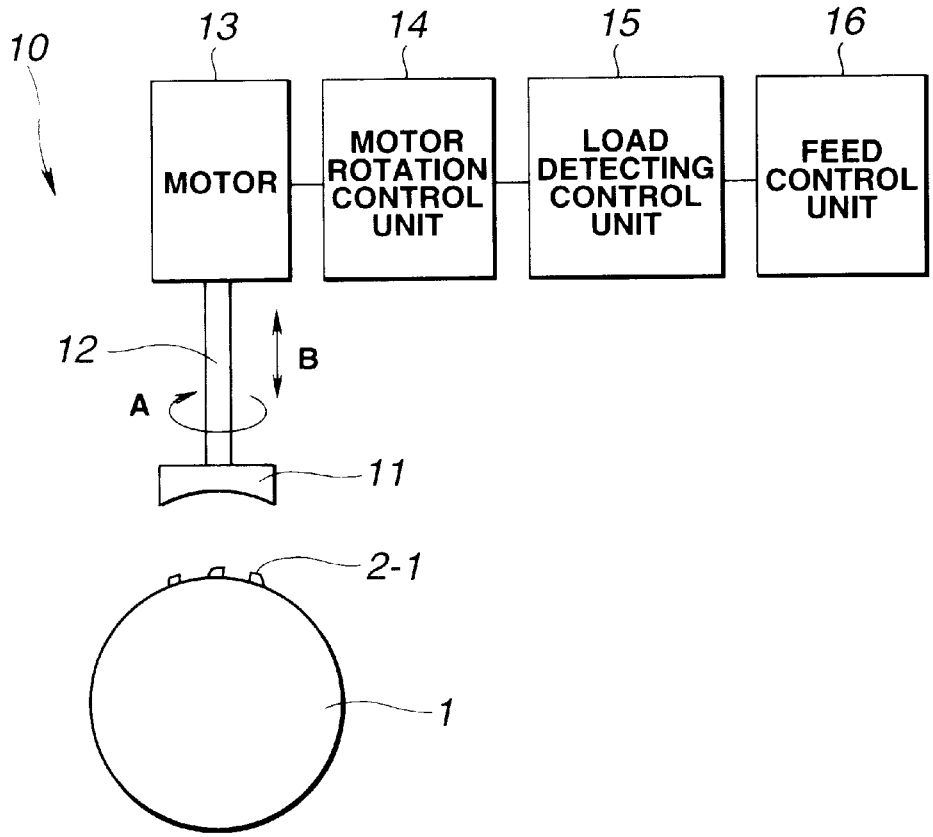
FIG. 1 is a block diagram showing the deburring method of the invention.

Referring to FIG. 1, there is illustrated an apparatus 10 for grinding away burrs 2-1 from a golf ball 1 according to one embodiment of the invention. This embodiment is effective for grinding away burrs 2-1 which are formed on the golf ball 1 at one pole and nearby positions as shown in FIG. 2A.

Figure 2A:
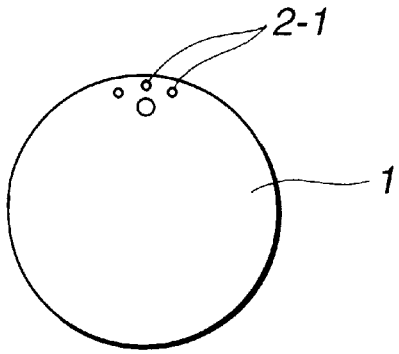
FIG. 2 is a perspective view of a golf ball to be ground by the method of the invention, FIG. 2A illustrating burrs formed at one pole and nearby and FIG. 2B illustrating burrs formed along the equator.

More particularly, when a golf ball is injection molded in a mold, as shown in FIG. 2A, burrs 2-1 are formed on the ball 1 at positions corresponding to the venting pins and core support pins. The region of the ball where burrs (to be removed) are formed is referred to as the burr-bearing region. The apparatus 10 shown in FIG. 1 is used as a grinding apparatus for removing the burrs.

The golf ball 1 is seated on a stationary platform having a concave top surface corresponding to the surface shape of the golf ball 1, though not shown. That is, the platform has a recessed seat conforming to the spherical surface of the ball for closely receiving the ball therein. An appropriate holder (not shown) is used to fixedly hold the ball at positions outside the burr-bearing region so that the burr-bearing region faces upward.

The grinding apparatus 10 includes a grinding means in the form of a grinding head or wheel 11, a drive means in the form of a motor 13 coupled to the grinding head 11 through a rotating shaft 12 and a feed mechanism (not shown) for moving back and forth the motor 13, a motor rotation control unit 14, a load detecting control unit 15, and a feed control unit 16. The control units are cooperatively coupled to the drive means.

The grinding head 11 has a lower concave surface corresponding to the curvature of the golf ball and serving as an abrasive or working surface. The abrasive surface has a sufficient diameter or width to cover the burr-bearing region of the golf ball surface. This diameter or width is usually about 5 to 30 mm, preferably about 10 to 20 mm.

To the upper surface of the grinding head 11 at its center is connected the rotating shaft 12 of the motor 13. When the motor 13 is actuated, the shaft 12 is rotated in the direction of arrow A or the opposite direction at a controlled speed so that the grinding head 11 is rotated about its axis together with the shaft 12. Additionally, the feed mechanism allows the motor 13 and the rotating shaft 12 to be moved vertically, that is, in the directions of arrow B, so that the grinding head 11 is moved toward and away from the golf ball together with the vertical movement of the motor 13 and shaft 12. The grinding head 11 is preferably rotated at about 1,000 to 4,000 rpm, more preferably about 1,500 to 2,500 rpm and moved toward the ball at a feed rate of about 3 to 100 mm/sec, more preferably about 5 to 20 mm/sec.

The motor 13 used herein is not critical although a DC motor is preferred. Since the apparatus is required to grind substantially only burrs, the motor 13 may be of relatively low power as represented by a torque of about 300 to 1,000 g-cm.

The load detecting control unit 15 is used to detect any variation of the rotation load on the grinding head 11 and deliver a control signal to the control unit 14 which controls the rotation of the motor in accordance with the control signal.

Specifically, the load detecting control unit 15 detects an abrupt increase of the rotational load on the grinding head 11 as an abrupt increase of electric current. While the grinding head 11 is grinding the burrs 2-1 on the golf ball 1, no substantial load is applied thereto because the burrs 2-1 have very small surface areas. When the burrs 2-1 have been ground away, the grinding head 11 comes in full contact with the surface of the golf ball 1 and receives a substantial load. The load detecting control unit 15 detects this abrupt increase of the rotational load on the grinding head 11.

The feed control unit 16 functions to bring and force the grinding head 11 against the ball 1 under a predetermined pressure, and to move the rotating shaft 12 upward to retract the grinding head 11 from the ball 1 surface in response to the change (abrupt increase) of the rotational load that is detected by the load detecting control unit 15. The feed mechanism associated with the feel control unit 16 for vertically moving the motor 13, rotating shaft 12 and grinding head 11 is not critical, and any of motors, pneumatic drives and hydraulic drives may be used.

Using the grinding apparatus 10 shown in FIG. 1, the burrs 2-1 are ground away from the golf ball 1 as follows. While the grinding head 11 is being rotated, it is advanced toward the ball 1 at a predetermined feed speed until it contacts the burrs 2-1. The burrs 2-1 are ground and removed in this way.

The grinding action of the grinding head 11 is not limited to the embodiment of FIG. 1 wherein the grinding head 11 is rotated about the center aligned with the rotating shaft 12 in the direction of arrow A or opposite direction. For example, a precession mechanism can be used. That is, while the grinding head 11 is being rotated with the rotating shaft 12, the grinding head 11 is given the swing motion or precession of turning around the north pole of the ball 1 to rub the north pole-adjoining region. Alternatively, while go the ball 1 is rotated about an axis connecting its north and south poles, the grinding head 11 is given the linear reciprocal motion or stroke of sliding back and forth along the curved surface of the ball 1.

In the above-described process of grinding the burrs 2-1 while the grinding head 11 is fed forward, the grinding head 11 comes in full contact with the surface of the ball 1 and receives a substantial load when the burrs 2-1 have been removed. The load detecting control unit 15 detects this change (abrupt increase) of the rotational load on the grinding head 11 in response to the complete removal of the burrs 2-1, and delivers a signal representing the completion of grinding to both the motor rotation control unit 14 and the feed control unit 16 so as to terminate the grinding operation. In response to the signal representing the completion of grinding, the motor rotation control unit 14 functions to decelerate or stop the motor 13 or reverse the motor 13, and the feed control unit 16 functions to retract the grinding head 11 away from the ball surface. Grinding is terminated in this way.

It is noted that the termination of grinding encompasses not only the case wherein grinding is terminated immediately after receipt of the signal representing the completion of grinding, but also the case wherein concomitant operation as described just above is carried out before grinding is terminated.

In grinding and removing burrs, the method of the invention merely requires that the termination of grinding be timed at the point of time when a change of the load on the drive means is detected. The remaining construction is not particularly limited.

In the embodiment of FIG. 1, in grinding those burrs formed in proximity to the opposed poles of the ball, for example, after grinding on the north pole side is finished, the ball is reversed and similar grinding is carried out on the south pole side. In an alternative embodiment, the ball is not seated on the holding platform, but the ball is clamped only at the equator zone and a pair of grinding apparatus are arranged on the north and south pole sides of the ball whereby grinding is simultaneously carried out on both the north and south pole sides according to the invention.

Figure 2B:
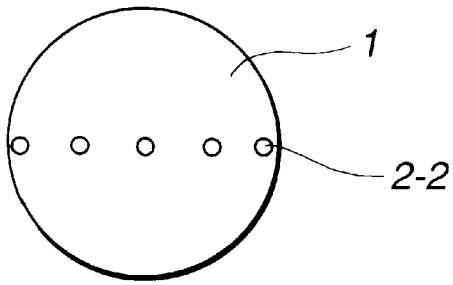
Figure 3:
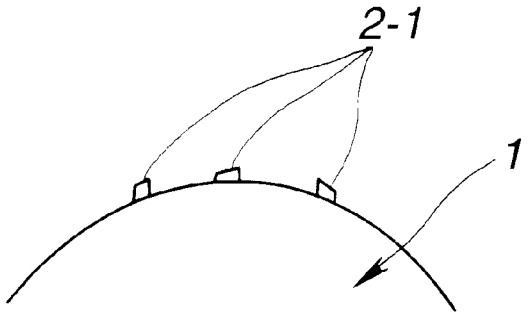
FIG. 3 is a partial enlarged view of a golf ball with burrs.
Figure 4:
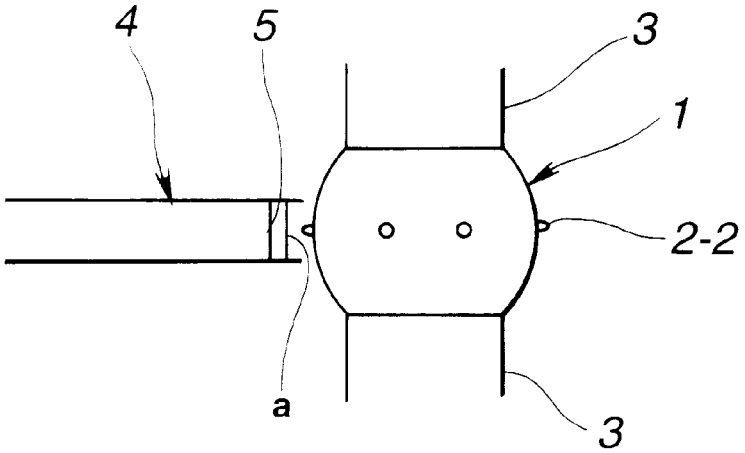
FIG.4 PRIOR ART
FIGS. 4 and 5 are a side view and a plan view illustrating a first prior art deburring method, respectively.
Figure 5:
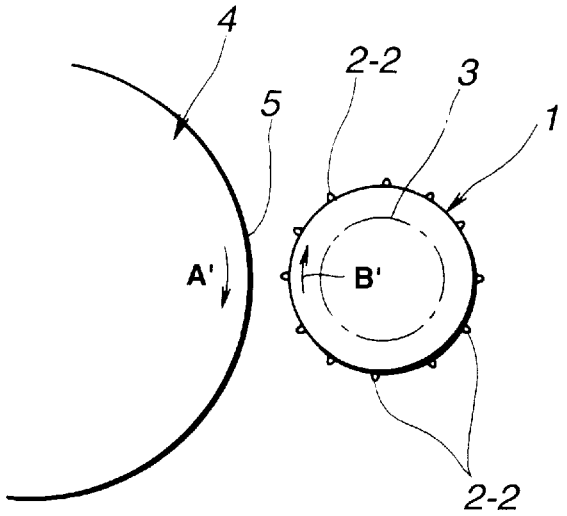
FIG.5 PRIOR ART
Figure 6:
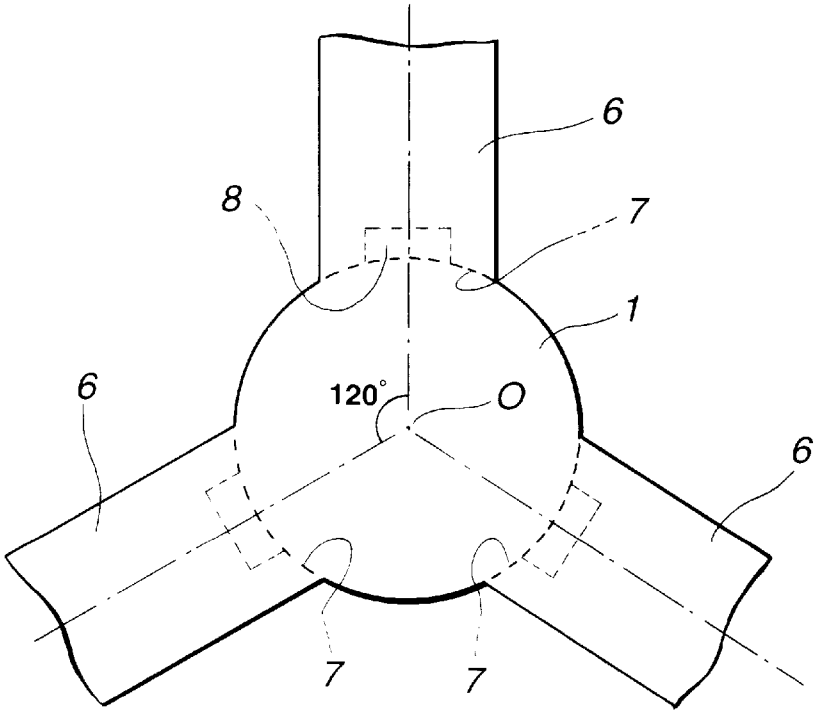
FIG.6 PRIOR ART
FIG. 6 is a side view illustrating a second prior art deburring method.
Figure 7:
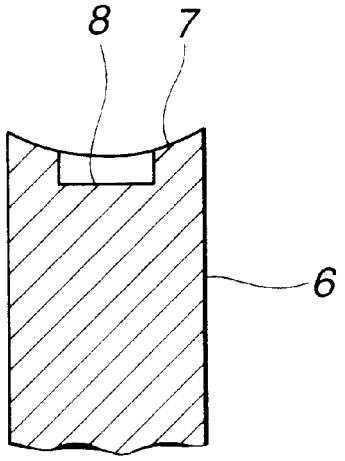
FIG.7 PRIOR ART
FIGS. 7 and 8 are a cross-sectional view and an end view a of one shaft in the grinding apparatus of FIG. 6, respectively.
Figure 8:
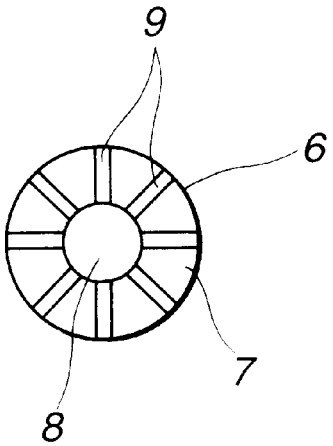
FIG.8 PRIOR ART

In FIG. 2B, burrs 2-2 are formed along the equator of a golf ball 1. The method of the invention is equally applicable to the grinding of equatorial burrs 2-2 by detecting a change of the load on the drive means.

The method for grinding an as-molded golf ball for deburring according to the invention is able to restrict grinding to only the burr-bearing region and avoid grinding of unnecessary regions. The golf ball can be ground for deburring without compromising the ball quality.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A method for grinding a golf ball as molded in the state that the ball has burrs in a surface region, by using a grinding means having an abrasive surface of a sufficient width or diameter to cover the region of the golf ball surface having burrs and a drive means for driving the grinding means, said method comprising the steps of:

actuating the drive means to drive the grinding means to bring and force the abrasive surface of the grinding means against the region of the golf ball surface having burrs for grinding away the burrs, and detecting the point of time when the drive means experiences a load change beyond a predetermined load, as a signal representing the substantial completion of grinding, for terminating the grinding step.

2. An apparatus for grinding a golf ball as molded in a state that the golf ball has burrs in a region of an outer curved surface of said golf ball, comprising:

grinding means having an abrasive surface with a sufficient width or diameter to cover a burr-bearing region of the golf ball surface, drive means for driving the grinding means in the form of an electric motor having a rotational output shaft, motor rotation control means to control the output rotation of the motor in accordance with a control signal, load detecting control means for detecting an abrupt increase of the rotational load on the grinding means as an abrupt increase of electric current to said motor, and feed control means to bring and force the grinding means against the golf ball under a predetermined pressure and terminate grinding in response to the abrupt increase of the rotational load.

3. An apparatus for grinding a golf ball of claim 2, wherein the grinding means has a lower concave surface corresponding to a curvature of the outer surface of the golf ball.

4. An apparatus for grinding a golf ball of claim 2, wherein a diameter or width of the abrasive surface is in the range of 5 to 30 mm.

5. An apparatus for grinding a golf ball of claim 2, wherein an upper surface of the grinding means is connected to the output shaft of the motor, thereby the shaft is rotated in one direction at a controlled speed so that the grinding means is rotated together with the output shaft.

6. An apparatus for grinding a golf ball of claim 5, wherein the feed control means allows the motor and the output shaft to be moved vertically so that the grinding means is moved toward and away from the golf ball together with the vertical movement of the motor and said output shaft.

7. An apparatus for grinding a golf ball of claim 6, wherein the grinding means is rotated at 1,000 to 4,000 rpm and is moved toward the golf ball at a feed rate in the range of 3 to 100 mm/sec.

8. An apparatus for grinding a golf ball of claim 5, wherein the grinding means has a swing motion around a north pole of the golf ball to rub a north pole-adjoining region of said golf ball while the grinding means is being rotated by the output shaft of said motor.

9. An apparatus for grinding a golf ball of claim 5, wherein the grinding means has a linear reciprocal motion along a curved surface of the golf ball while the golf ball is rotated about an axis connecting north and south poles of said golf ball.

10. An apparatus for grinding a golf ball of claim 2, wherein the feed control means terminates grinding by said grinding means by moving the output shaft upward to retract the grinding means from the golf ball surface.

11. An apparatus for grinding a golf ball of claim 2, further comprising a stationary platform having a concave top surface corresponding to the outer curved surface shape of the golf ball.

12. An apparatus for grinding a golf ball of claim 2, wherein the golf ball has burrs formed on north and south poles of said golf ball.

13. An apparatus for grinding a golf ball of claim 12, wherein after grinding on the north pole side is finished, the golf ball is reversed and similar grinding is carried out on the south pole side.

14. An apparatus for grinding a golf ball of claim 12, further comprising second grinding means having an abrasive surface and wherein the golf ball is clamped only at an equator zone and grinding is simultaneously carried out on both north and south pole sides of the golf ball by having said grinding means and said second grinding means arranged at respective poles of said golf ball.

15. An apparatus for grinding a golf ball of claim 2, wherein the ball having burrs formed along an equator of the ball.

* * * * *